United States Patent [19]

Gustafsson

[11] Patent Number: 5,014,796

[45] Date of Patent: May 14, 1991

[54] DOWN HOLE DRILLS USING SPENT DRIVING FLUID FOR FLUSHING PURPOSES

[76] Inventor: Per Gustafsson, 4, Chemin de Bouvreuiles, 1009 Pully, Switzerland

[21] Appl. No.: 462,493

[22] Filed: Jan. 8, 1990

Related U.S. Application Data

[63] Continuation-in-part of PCT SE88/00370 filed Jul. 6, 1988, published as W089/00638 on Jan. 26, 1989.

[30] Foreign Application Priority Data

Jul. 14, 1987 [SE] Sweden ..... 8702860

[51] Int. Cl.[5] ..... E21B 4/14

[52] U.S. Cl. ..... 175/296; 173/78; 173/91; 173/112

[58] Field of Search ..... 175/296, 19; 173/78, 173/59, 91, 112, 139

[56] References Cited

U.S. PATENT DOCUMENTS

| | | | |
|---|---|---|---|
| 3,095,046 | 6/1963 | Mori | 175/296 X |
| 3,198,264 | 8/1965 | Oelke et al. | 173/73 |
| 4,367,800 | 1/1983 | Arentsen | 173/127 |
| 4,444,274 | 4/1984 | Suwabe | 173/134 |
| 4,545,444 | 10/1985 | Webb et al. | 175/296 |
| 4,596,292 | 6/1986 | Crover | 175/296 X |
| 4,660,658 | 4/1987 | Gustafsson | 175/296 |

FOREIGN PATENT DOCUMENTS

| | | |
|---|---|---|
| 3343565 | 11/1985 | Fed. Rep. of Germany . |
| 444127 | 3/1986 | Sweden . |

*Primary Examiner*—Stephen J. Novosad

*Attorney, Agent, or Firm*—Nils H. Ljungman & Associates

[57] ABSTRACT

In a water driven down-the-hole rock drill, the rearward end of an associated hammer is provided with a drive piston reciprocable in a cylinder located adjacent the rear of the drill. The front end of the hammer is guided for reciprocation in a bearing located adjacent an anvil of a drill bit. Between the cylinder and the bearing the hammer is elongated and enlarged diametrically relative to the piston. The enlarged hammer portion reciprocates freely in a chamber formed by an outer casing of the drill. Drive water is expelled from the cylinder and flushes the hole drilled by the bit. An open ended tubular valve reciprocates to control a duct connecting the interior of the valve to coaxial through-flushing channels in the hammer and the drill bit.

22 Claims, 4 Drawing Sheets

DOWN HOLE DRILLS USING SPENT DRIVING FLUID FOR FLUSHING PURPOSES

CROSS REFERENCE TO RELATED APPLICATIONS

This application is a continuation-in-part of International Application PCT/SE88/00370 filed on July 6, 1988 designating the U.S. which claims priority from Swedish Patent Application No. 8702860-1 filed on July 14, 1987.

BACKGROUND OF THE INVENTION

Field of the Invention

The present invention relates generally to hydraulic down hole or down-the-hole drills.

The output power of down-the-hole drills and the penetration rate are usually low as compared with top-hammer drills. Still, such down hole drills are widely used because the overall cost per meter of drilling distance or depth is comparatively low for this kind of drilling and because the penetration rate is not substantial reduced as the hole becomes deeper.

Conventionally, the drive fluid is compressed air, but hydraulically operated down-the-hole drills are known at least in the patent literature. In practice, however, severe difficulties have been encountered when a hydraulic drive fluid is also used as a flushing fluid. Top hammer drills generally use a closed hydraulic circuit so that they can be operated by oil.

Most down-the-hole rock drills are generally pneumatic. In air operated hammers using open systems are usual because of the somewhat small outer diameter of a down-the-hole rock drill. The output of impact energy is hence rather small, as compared to a modern top hammer. An open hydraulic system for a down-the-hole hammer cannot usually use oil. Further, the lack of lubricant will often be a severe problem.

It has thus been proven difficult to combine high impact power, reliable operation and expected long life of drill components.

Accordingly, it is an object of the invention to provide a down-the-hole drill which combines high output impact power, power economy, and long expected life of drill components.

SUMMARY OF THE INVENTION

This invention relates to hydraulic down-the-hole drills, which, as the name signifies, are disposed in holes in the earth to drill further into the earth, particularly drilling through rock located beneath overlays of soft earth.

The invention is concerned with a hydraulic down-the-hole rock drill comprising a casing arranged to be mounted to the front end of a drill tube. A drill bit is slidably received and retained by the front end of the casing and has a channel extending longitudinal therethrough. A head is located adjacent the rear of the casing, and a port in the head is arranged to be supplied with pressurized hydraulic fluid from the drill tube. A piston hammer is provided to repetitively deliver impacts to the said drill bit and has a longitudinal channel extending therethrough. A control valve is located forwardly of the port and a flushing fluid channel extends from the valve to the front end of the drill bit. The flushing channel includes the channels in the piston hammer and in the drill bit.

The piston hammer has, in addition, a first piston surface in a first pressure chamber to drive the piston hammer forwardly when the first pressure chamber is pressurized. The hammer has a second piston surface in a second chamber arranged to drive the piston hammer rearwardly when the first chamber is depressurized. The control valve is arranged to connect alternately the first pressure chamber to the port and to the flushing channel to reciprocate the piston hammer. Such a rock drill is usually hereinafter called "a down-the-hole drill of the kind set forth".

It is therefore an object of the invention to provide a hydraulic down-the-hole rock drill that uses spent drive fluid as a flushing fluid and combines high impact power, reliable operation, and long expected life. To this end, according to one aspect of the invention, an hydraulic down-the-hole drill of the kind set forth is provided, characterized in that the piston hammer comprises a major central portion located in a central chamber in the casing, and front and rear portion having reduced diameters. The casing comprises guiding portions for receiving and guiding the front and rear portions of the piston hammer. The central portion of the piston hammer has a clearance in the casing to permit hydraulic fluid to by-pass the central portion during reciprocation of the piston hammer. The control valve is located in the head rearwardly of the piston hammer.

The central portion of the piston hammer provides a heavy portion to permit blows of substantial energy while the reduced diameter portions provide guiding of the hammer at reduced friction and wear. The clearance between the hammer and casing can therefore be minimized so that any leaking of driving fluid will be small and power of economy (power efficiency) will be good.

BRIEF DESCRIPTION OF THE DRAWINGS

Embodiments of the invention will now be described by way of example with reference to the accompanying drawings in which:

In FIG. 7 the actual position and number of passages are shown whereas the same passages are presented schematically in FIGS. 5 and 6.

DESCRIPTION OF THE PREFERRED EMBODIMENTS

Figure 1A:
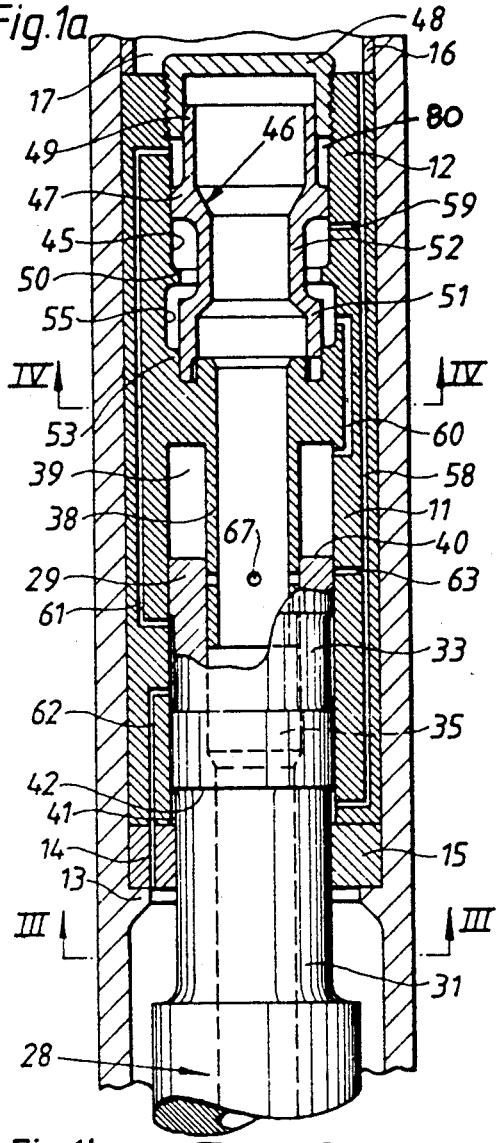
FIG. 1*a* and FIG. 1*b* show fragmentary longitudinal sections of the rearward and the forward parts respectively, of a first embodiment of a down-the-hole rock drill with a hammer located in a forward position, the section being taken on lines 1—1 in FIG. 3.
Figure 1B:
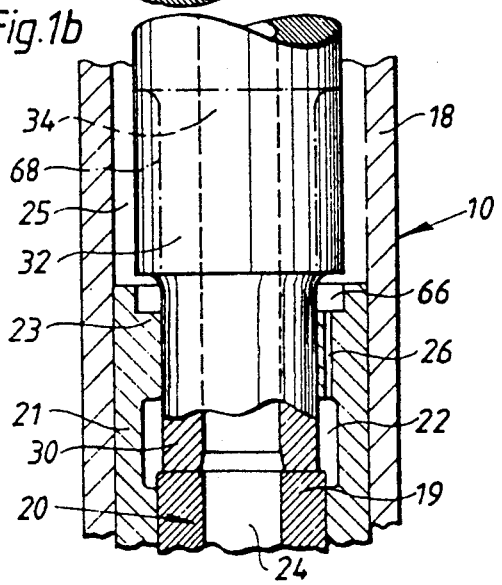
Figure 3:
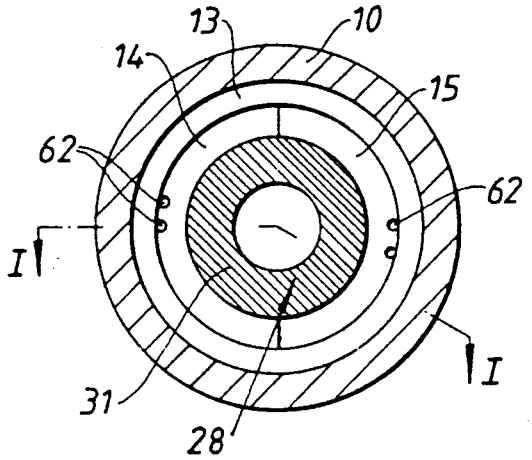
FIG. 3 is a cross section on lines 3—3 in FIG. 1*a;*

Referring now to the FIGS. 1*a* and 1*b*, there is shown a casing 18 of a rock drill 10 consisting of an elongated cylindrical tube typically of relatively even thickness which has an internal annular abutment 13. A cylinder 11, preferably integral with a valve chest 12, is received in the casing 18 and is supported by radially divided ring structure 14 and 15 (also seen in FIG. 3) that rests against the abutment 13. The cylinder 11 is fixed axially in the casing 18 by a tubular liner 16 extending between the rear face of the valve chest 12 and a backhead, not shown. Liner 16 is fixedly threaded to a rear portion of the casing 18 and is adapted to transmit rotation to the casing 18 in a conventional manner.

The interior of the liner 16 forms a port 17, usually supplied with usual drill tubes that employ high pressure liquid, preferably water. The water is supplied via the backhead and port and serves to drive the down-the-hole drill.

As fragmentarily shown in FIG. 1*b*, a drill bit 20 is slidably received and retained in a collar 21 threaded to the forward end of the casing 18. An anvil 19 of the drill bit 20 protrudes into an annular groove 22 of the collar 21. Rearwardly of the groove 22 there is provided a guide bearing 23 in the collar 21. The drill bit 20 has the usual through flushing channel 24 therein leading to its working end, and the usual splined connection (not shown) is provided between the the collar 21 and the drill bit 20 whereby rotation is transmitted thereto from the casing 18.

An elongated chamber 25 formed by the casing 18 extends between the guide bearing 23 of the drill bit collar 21 and the divided ring structure 14 and 15 of the cylinder 11. The chamber 25 is kept permanently at low liquid pressure i.e. relief pressure thanks to one or more relief passages 26 connecting the chamber 25 with the annular groove 22 that communicates with the flushing channel 24 in the drill bit 20.

A hammer 28 is reciprocable in the casing 18 for repeatedly delivering impacts to the anvil 19 of the drill bit 20. On the rear portion and preferably at the actual rear end of the hammer 28 is provided a driving piston 29. The impacting frontal end of the hammer 28 is formed as a journal 30 slidingly received in the guide bearing 23 of the collar 21. A cylindrical enlarged hammer portion 32 is reciprocably provided in the chamber 25. The diametric enlargement 32 serves to increase the impact energy of the hammer 28 and has a sufficient clearance within the chamber 25 for allowing substantially unhindered movement of low pressure liquid between the ends of the chamber 25 when the hammer 28 is reciprocating.

A reduced throat 31 is provided between the piston 29 and the enlarged hammer portion 32 and preferably has a diameter equal to the diameter of the journal 30. The throat 31 is sealingly surround by the radially divided ring structure 14, 15 and is freely reciprocable therein.

An axial flushing channel 34 extends centrally through the hammer 28 and has in its rear an enlarged bore 35 within the piston 29 which is sealingly slidable on a central low pressure or relief duct 38 coaxially forming part of or affixed to the cylinder 11. The duct 38 is in open communication with the central piston channel 34 and with the interior of the valve chest 12.

The piston 29 is slidingly and sealingly received in the cylinder 11 forming a drive chamber 39 therein faced by the rear end surface 40 of the piston 29 which chamber 39 serves to drive the hammer 28 forwardly in its working stroke.

Around the reduced throat 31 is provided an opposite cylinder chamber 41 faced by an annular opposite drive surface 42 which is smaller than the drive surface 40 and is adapted to force the piston 29 rearwardly to perform a return stroke of the hammer 28.

The valve chest 12 has an axial bore 45 in which a tubular control valve 46 (preferably a spool valve) is reciprocable. The interior of the control valve 46 is permanently open to the duct 38 and thus maintained at the low liquid pressure of the flushing channels 34 and 24. The control valve 46 has a differential piston 47 sealingly and slidably received in the axial bore 45, which is closed by a cap 48 threaded to the chest 12. The cap 48 slidingly and sealingly receives therein an upper skirt 49 of the control valve 46. The opposite end to the control valve forms a lower skirt 51. A reduced waist 52 is provided between the lower skirt 51 and the differential piston 47. The outer diameter of the lower skirt 51 is somewhat larger than the outer diameter of the upper skirt 49 and somewhat smaller than the diameter of the bore 45. The bore 45 is terminated by an intermediate land 50 followed by an annular internal groove 55 and a lower land 53 of equal diameter with the intermediate land 50. Protruding guiding tags 54 (see FIG. 2) are provided on the axial face of the lower skirt 51 and serve as guides when the control valve 46 reciprocates between the position in FIG. 1*a*, in which the lower skirt 51 seals against the lower land 53 and the position in FIG. 2, in which the lower skirt 51 seals against the intermediate land 50.

Figure 2:
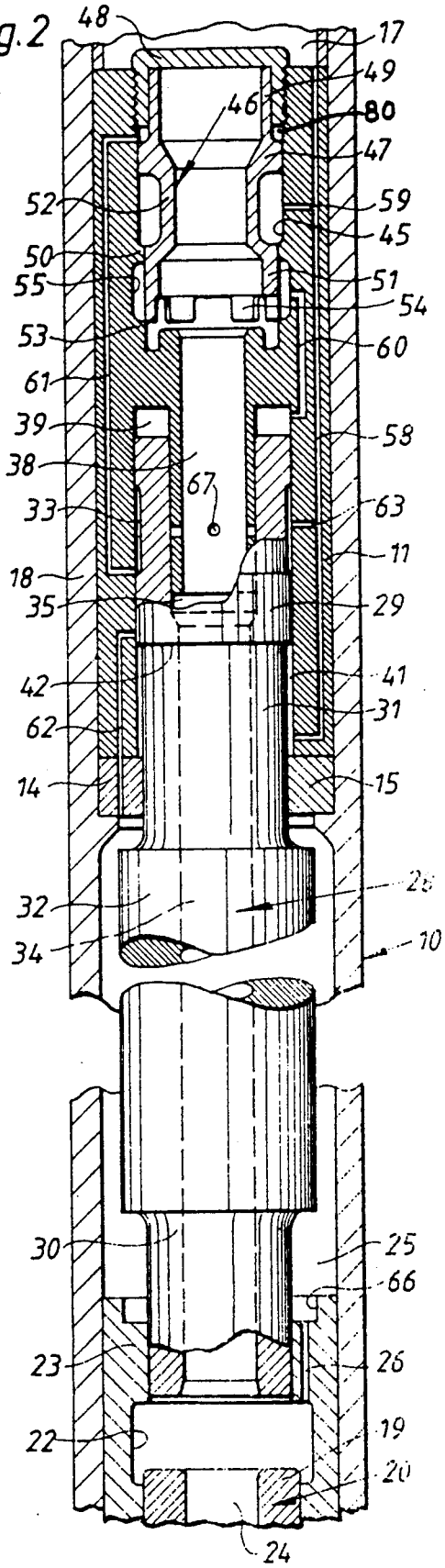
FIG. 2 is a shortened fragmentary sectional view corresponding to those of FIGS. 1*a* and 1*b* with the hammer disposed in a rearward position.
Figure 4:
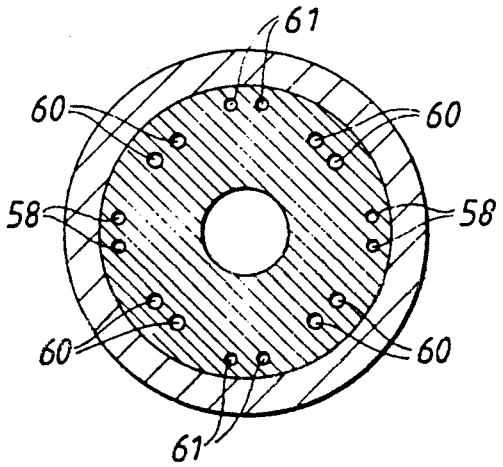
FIG. 4 is a cross section on lines 4—4 in FIg. 1*a;*

Liquid passages 58 (also seen in FIG. 4) connect via branch passages 59 the high pressure port 17 with the valve bore 45 to provide a permanent underside pressure on differential valve piston 47 whereby control valve 46 is biased towards the rear position shown in FIG. 2. Passages 58 furthermore extend to the cylinder chamber 41 in the cylinder 11 whereby the hammer 28 likewise is permanently biased to the rear position shown in FIG. 2. Liquid passages 60 connect the upper part of the drive cylinder chamber 39 with the annular internal groove 55 in the valve chest 12.

In operation, the control valve 46 is adapted to reciprocate in response to movement of the hammer 28 more specifically in response to the position of the control groove 33 on the piston 29 thereof. To this end, control passages 61, as shown in FIGS. 1*a* and 2, extend to connect a control chamber 80 located at the upper end of valve bore 45 with the cylinder wall between chambers 39 and 41. These chambers are aligned with the piston control groove 33, which, as shown in the FIG. 1*a* position, connects control passages 61 to liquid passages 62 that lead to low pressure chamber 25. With relief of the upper end of valve bore 45 the above-mentioned upward valve bias brings the control valve 46 up to its FIG. 2 position wherein the lower valve skirt 51 seals against the intermediate land 50.

Thus, when the hammer 28 in FIg. 1*b* impacts on the anvil 19 and the upper end of the valve bore 45 is relieved, the high pressure transmitted from port 17 via passages 58 and 59 to the lower end of the valve bore 45 brings control valve 46 to the FIG. 2 position. At this instant and until the hammer 28 under its upward bias has moved to the FIG. 2 position, the drive chamber 39 will be emptied to duct 38 via the passages 60 and the open lower land 53. The escaping liquid is directed through channels 34 and 34 to flush the hole drilled in the rock by drill bit 20.

When reaching the rear position in FIG. 2, the control groove 33 of the piston 29 connects branch passages 63 from high pressure passages 58 to the passages 61. This pressurizes the end of valve bore 45. Due to the difference in diameters between the valve skirts 49 and 51, the rear surface of differential valve piston 47 is larger than the opposite net surface producing the permanent rearward bias on valve piston 47, and as an consequence the control valve is brought back to the FIG. 1*a* position. Herein the intermediate valve land 50 is opened and the drive cylinder chamber 39 is connected to high liquid pressure via passages 58 and 59, valve waist 52 and passages 60. As a consequence the hammer 28 is urged to perform its working stroke so as to impact on the anvil 19 of the drill bit, see FIg. 1*b*. The above described operating cycle is then repeated.

In an uplifted position of the rock drill, the drill bit 20 will sink forwardly somewhat from the position shown in FIG. 1*b*. The enlarged portion 32 of the hammer 28 at such instant is caught and the hammer arrested and lowered to a forward bore 66 in chamber 25. Simultaneously, the high pressure branch passages 63 are opened to drive chamber 39. Chamber 39 is relieved for intensive liquid flushing via bores 67 (provided in the wall of duct 38) into the duct 38 for purposes of varying the impact energy of the subject rock drill.

Chamber 25 can be combined with hammers having enlarged portions 32 of varying length. Such a possibility is indicated by phantom lines for a hammer 68 in FIg. 1*b*.

Water can be delivered to port 17 on the order of 180 bars (18 MPa). Varying liquid demand during hammer reciprocation is normally equalized by compression and re-expansion of the water column in the tubing supplying rock drill 10 with liquid, whereby use of down-hole gas-loaded accumulators is avoided.

With a water pressure of 180 bar (18 MPa) and a drill casing diameter of 96 mm, for example, the novel valve design permits one an impact energy of about 25–30 kW and a blow frequency near 60 Herz. Water consumption of about 150–200 liters/minute produces a flushing water speed of more than 0.6 meters/sec, which at an attained hole diameter of 116 mm is sufficient for efficiently lifting away debris at vertical drilling.

Figure 5:
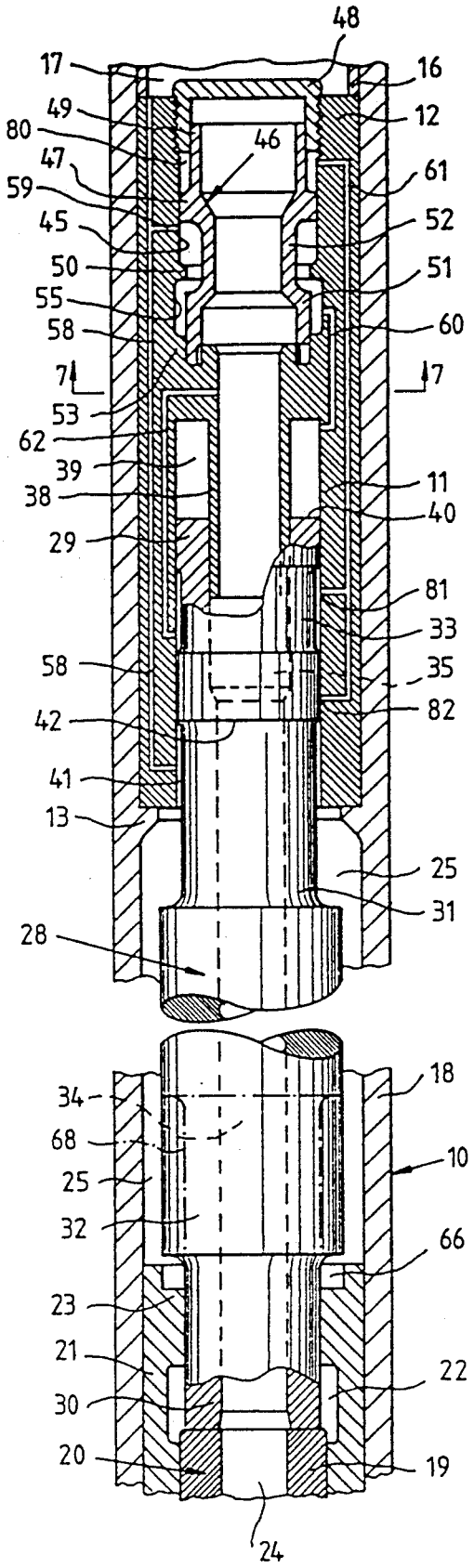
FIG. 5 is a fragmentary longitudinal section corresponding to FIG. 1 of a modified embodiment.
Figure 6:
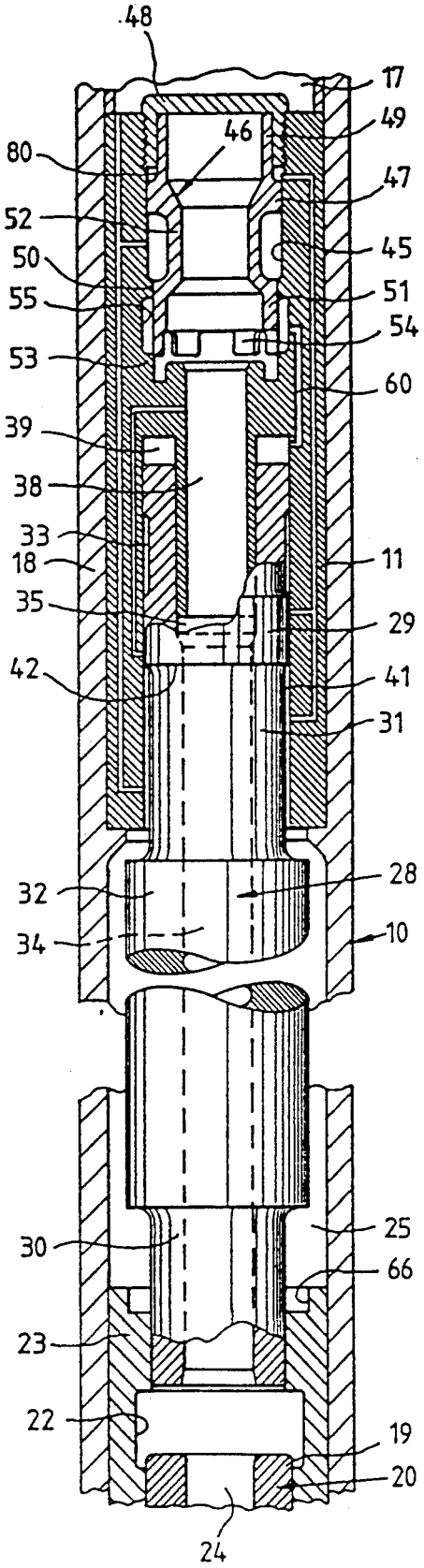
FIG. 6 is a section corresponding to FIG. 2.
Figure 7:
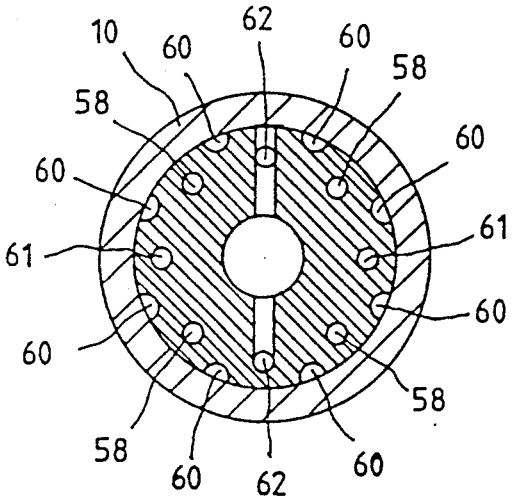
FIG. 7 is a cross section along lines 7—7 in FIG. 5.

A down-the-hole rock drill is shown in FIGS. 5 to 7 that differs from the one shown in FIGS. 1 to 4. In the embodiments of FIGS. 5 to 7, there are no ring structure 14 and 15 that form a sealing partition between the two chambers 41 and 25. In this manner, chambers of 41 and 25 become integral and are therefore continuously pressurized through the passages 58. Relief passages 26 in collar 21 are therefore usually not needed.

If, as shown, the diameters of the two hammer portions 30 and 31 on either sides of the enlarged hammer portion 32 are equal, the effective piston area (drive surface 42) for forcing the hammer 28 upwardly to its return stroke will typically be the same in the two embodiments.

Since the chamber 25 is continuously pressurized, passage 62 leads to the relief duct 38 instead of to the chamber 25.

No other changes in the valve control are usually necessary in the embodiment of FIGS. 5 to 7. However, an alternative control is shown in FIGS. 5 to 7. The control passage 61 has a port 81 through which the control passage 61 is depressurized through the control groove 33, as shown in FIG. 5, and another port 82, through which the control passage 61 is pressurized from the chambers 41 and 25, as shown in FIG. 6. In FIGS. 5 and 6, the passages are shown schematically, but in FIG. 7, the actual number and positions of the passages 58, 60, 61 and 62 are shown.

In summary, one feature of the invention resides broadly in an hydraulic down-the-hole drill of the kind set forth characterized in that a piston hammer 28 comprises a major central portion 32 located in a central chamber 25 in a casing 18 and a front 30 and a rear 29,31 portion having reduced diameters, the casing 18 having guiding portions 23, 11 for receiving and guiding the front and rear portions 30 and 29, 31 respectively of the piston hammer whereas the central portion 32 of the piston hammer has a clearance to the casing to permit hydraulic fluid to by-pass the central portion 32 during the reciprocation of the piston hammer, and a valve 46 is arranged in a head 12 located rearwardly of the piston hammer.

Another feature of the invention resides broadly in a rock drill characterized in that head 12 comprises the piston hammer 28, and a first piston surface 40 which is the annular end face of the rear portion 29, 31 of the piston hammer.

Yet another feature of the invention resides broadly in a rock drill characterized in that valve 46 is a spool valve that is coaxial with a duct or tube 38 and has a rearward position in which it connects a first chamber 39 to a tube 38 and a forward position in which it connects a first chamber 39 to a port 17.

A further feature of the invention resides broadly in a rock drill characterized in that, in operation, a second chamber 41 is continuously pressurized and the second piston surface 42 has a smaller effective area than the first piston surface 40.

A yet further feature of the invention resides broadly in a rock drill characterized in that the second chamber 41 and the central chamber 25 are separated, and the second chamber 41 is located between the first chamber 39 and the central chamber 25.

Yet another further feature of the invention resides broadly in a rock drill characterized in that the central chamber 25 is connected to flushing fluid channels 38, 34 and 24 through a narrow passage 26.

An additional feature of the invention resides broadly in a rock drill characterized in that the central chamber 25 and the second chamber 41 are an enlarged chamber 41, 25 that is continuously pressurized.

A yet additional feature of the invention resides broadly in a rock drill characterized in that the control valve 46 is pressure biased in one direction and is adapted to reciprocate in response to the position of hammer 28 by the intermediary of an annular control groove 33 provided on piston 29 alternately relieving valve 46 to the said flushing channel 24 so as to move it in said one direction and pressurizing valve 46 to move it in the opposite direction.

A further additional feature of the invention resides broadly in a hydraulic down-the-hole drill having parts arranged and in operation substantially as hereinbefore described with reference to and as illustrated in any one or more the accompanying drawings.

Further summarizing, in a water driven down-the-hole rock drill 10, the rear end of the hammer 28 is provided with a short drive piston 29 reciprocable in a cylinder 11 at the rear end of the drill 10. The front end 30 of the hammer 28 is guided for reciprocation in a bearing 23 adjacent to the anvil 19 of the drill bit 20. Between the cylinder casing 11 and the bearing 23 the hammer 28 is elongated and enlarged 32 diametrically relative to its piston 29. The enlarged hammer portion 32 reciprocates freely in a chamber 25 formed by the outer casing 18 of the drill 10. The chamber 25 is permanently maintained at the relief water pressure of the drill 10 and the drive water expelled from the cylinder 11 flushes the hole drilled. An open ended tubular valve 46 reciprocates to control a duct 38 connecting the interior of the valve 46 to coaxial through-flushing channels in the hammer 28 and the drill bit 20.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

Other down-the-hole rock drills are described, for example, in German Patent 33 43 565 published on Nov. 14, 1985 and in Swedish Laid-Open Patent Application 444 127 published on Mar. 24, 1986.

The invention as described hereinabove in the context of the preferred embodiment is not to be taken as limited to all of the provided details thereof, since modifications and variations thereof may be made without departing from the spirit and scope of the invention.

What is claimed is:

1. A hydraulic down-the-hole rock drill comprising:

a casing:

a piston hammer located in said casing:

said piston hammer having a major central portion and opposed end portions of reduced diameter;

means for guiding said end portions in said casing;

a central chamber being provided in said casing containing said major portion of said piston hammer; and a clearance being provided between said major portion of said hammer and said casing to permit hydraulic fluid to bypass said major portion during reciprocation of said piston hammer in said central chamber.

2. A rock drill according to claim 1, in which said casing has means for admitting hydraulic fluid to said drill, said means including;

port means provided in said casing; and a valve located between said port means and said piston hammer.

3. A rock drill according to claim 2 in which said means for admitting fluid to a drill further includes;

a first annular surface comprising an end of the reduced diameter portion of said hammer that faces in the direction of said valve.

4. A rock drill according to claim 2, in which said valve is a spool valve located in coaxial alignment with (a) said port means;

(b) a duct located between said hammer and spool valve: and (c) a first chamber located adjacent said duct, said valve having a position that connects said first chamber to said duct, and a position that connects said chamber to said port means.

5. A rock drill according to claim 2 in which a second chamber is located about the reduced diameter portion of said hammer facing said valve for being subjected to pressurization; and a second annular hammer surface facing said second chamber has a smaller effective area than said first surface.

6. A rock drill according to claim 4 including:

a drill bit;

a channel extending through said hammer and between said duct and said drill bit;

a channel provided in said bit and connected to a channel in said hammer;

said duct and channels providing means to conduct hydraulic fluid through said hammer and said drill bit; and a narrow passage connecting said central chamber of said major portion of said hammer to said channels of said hammer and said drill bit.

7. A rock drill according to claim 4 including:

a driving piston located about said duct and connected to said piston hammer:

an annular groove provided in said drive piston:

said groove being effective to alternately connect said valve to said channel in said drill bit, and thereby move said valve in one direction, and pressurize said valve in a manner that moves said valve in the opposite direction; and said valve being adapted to reciprocate with said hammer and said piston.

8. A rock drill according to claim 1, in which said casing is arranged to be mounted to the front end of a drill tube;

a drill bit slidably received and retained by the front end of said casing and having a channel extending longitudinally therethrough;

a head located at the rear of said casing:

a port means in said head and arranged for being supplied with pressurized hydraulic fluid from said drill tube:

said piston hammer being arranged to repetitively deliver impacts to said drill bit and having a longitudinal channel therethrough;

a flushing channel extending from said valve to the front end of said drill bit and including said channels in said piston hammer and said drill bit said piston hammer having a first surface located in a first pressure chamber for driving said piston hammer forwardly when said first pressure chamber is pressurized, and a second surface in a second chamber arranged for driving said piston hammer rearwardly when said first chamber is depressurized, said valve being arranged to alternately connect said first pressure chamber to said port means and to said flushing channels so as to reciprocate said piston hammer, said piston hammer comprises;

a major central portion in a central chamber in the casing and front and rear portions having reduced diameters;

said casing including guiding portions for receiving and guiding said front and rear portions respectively of said piston hammer whereas said central portion of said piston hammer has a clearance to said casing to permit hydraulic fluid to bypass said central portion during reciprocation of said piston hammer:

said valve being arranged in said head rearwardly of said piston hammer;

said head including a tube sealingly extending into said channel in said piston hammer, said first piston surface being said annular end face of said rear portion of said piston hammer;

said valve being a spool valve that is coaxial with said tube and has a rearward position in which it connects said first chamber to said tube and a forward position in which it connects said first chamber to said port means:

wherein, in operation, said second chamber is continuously pressurized and said second piston surface has a smaller effective area than said first piston surface:

said second chamber and said central chamber are separated with said second chamber being located between said first chamber and said central chamber:

said central chamber being connected to said flushing channel through a narrow passage; and said valve is adapted to be pressure biased in one direction and adapted to reciprocate in response to the position of said hammer by the intermediary of an annular control groove provided on a drive piston that serves to alternately relieve said valve to said flushing channel, and which moves said valve in one direction and pressurizing said valve to move it in the opposite direction.

9. A hydraulic down-the-hole rock drill comprising:

a casing;

a piston hammer located in said casing;

said piston hammer having a major central portion and opposed first and second end portions;

means for guiding said end portions in said casing;

a central chamber provided in said casing containing said major portion of said piston hammer;

a clearance provided between said major portion of said hammer and said casing to permit hydraulic fluid to bypass said major portion during reciprocation of said piston hammer in said central chamber;

said first opposed end portion comprising an annular drive surface;

at least a portion of said annular drive surface having a dimensional measure;

at least a portion of said second opposed end portion having an dimensional measure; and said dimensional measure of said at least a portion of said annular drive surface being greater than said dimensional measure of said at least a portion of said second opposed end portion.

10. A rock drill according to claim 9, in which said casing has means for admitting hydraulic fluid to said drill, said means including;

port means provided in said casing; and a valve located between said port means and said piston hammer.

11. A rock drill according to claim 10, in which said means for admitting fluid to a drill further includes;

a first annular surface comprising portion of said hammer that faces in the direction of said valve.

12. A rock drill according to claim 10, in which said valve is a spool valve located in coaxial alignment with (a) said port means;

(b) a duct located between said hammer and spool valve; and (c) a first chamber located adjacent said duct, said valve having a position that connects said first chamber to said duct, and a position that connects said chamber to said port means.

13. A rock drill according to claim 10, in which a second chamber is located about a portion of said hammer facing said valve for being subjected to pressurization; and a second annular hammer surface facing said second chamber has a smaller effective area than said first surface.

14. A rock drill according to claim 12 including:

a drill bit;

a channel extending through said hammer and between said duct and said drill bit;

a channel provided in said bit and connected to a channel in said hammer;

said duct and channels providing means to conduct hydraulic fluid through said hammer and said drill bit; and a narrow passage connecting said central chamber of said major portion of said hammer to said channels of said hammer and said drill bit.

15. A rock drill according to claim 10, including:

a driving piston located about said duct and connected to said piston hammer;

an annular groove provided in said drive piston;

said groove being effective to alternately connect said valve to said channel in said drill bit, and thereby move said valve in one direction, and pressurize said valve in a manner that moves said valve in the opposite direction; and said valve being adapted to reciprocate with said hammer and said piston.

16. A rock drill according to claim 9, in which said casing is arranged to be mounted to the front end of a drill tube;

a drill bit slidably received and retained by the front end of said casing and having a channel extending longitudinally therethrough;

a head located at the rear of said casing;

a port means in said head and arranged for being supplied with pressurized hydraulic fluid from said drill tube;

said piston hammer being arranged to repetitively deliver impacts to said drill bit and having a longitudinal channel therethrough;

a flushing channel extending from said valve to the front end of said drill bit and including said channels in said piston hammer and said drill bit;

said piston hammer having a first surface located in a first pressure chamber for driving said piston hammer forwardly when said first pressure chamber is pressurized, and a second surface in a second chamber arranged for driving said piston hammer rearwardly when said first chamber is depressurized, said valve being arranged to alternately connect said first pressure chamber to said port means and to said flushing channels so as to reciprocate said piston hammer, said piston hammer comprises;

a major central portion in a central chamber in the casing and front and rear portions having reduced diameters;

said casing including guiding portions for receiving and guiding said front and rear portions respectively of said piston hammer whereas said central portion of said piston hammer has a clearance to said casing to permit hydraulic fluid to bypass said central portion during reciprocation of said piston hammer;

said valve being arranged in said head rearwardly of said piston hammer;

said head including a tube sealingly extending into said channel in said piston hammer, said first piston surface being said annular end face of said rear portion of said piston hammer;

said valve being a spool valve that is coaxial with said tube and has a rearward position in which it connects said first chamber to said tube and a forward position in which it connects said first chamber to said port means;

wherein, in operation, said second chamber is continuously pressurized and said second piston surface has a smaller effective area than said first piston surface;

said second chamber and said central chamber are separated with said second chamber being located between said first chamber and said central chamber;

said central chamber being connected to said flushing channel through a narrow passage; and said valve is adapted to be pressure biased in one direction and adapted to reciprocate in response to the position of said hammer by the intermediary of an annular control groove provided on a drive piston that serves to alternately relieve said valve to said flushing channel, and which moves said valve in one direction and pressurizing said valve to move it in the opposite direction.

17. A hydraulic down-the-hole rock drill that uses spent drive liquid as a flushing fluid, said drill comprising:

a casing;

a piston hammer located in said casing;

said piston hammer having a major central portion and opposed first and second end portions;

means for guiding said end portions in said casing;

a central chamber provided in said casing containing said major portion of said piston hammer;

a clearance provided between said major portion of said hammer and said casing to permit hydraulic fluid to bypass said major portion during reciprocation of said piston hammer in said central chamber;

said first opposed end portion comprising an annular drive surface;

at least a portion of said annular drive surface having a dimensional measure;

at least a portion of said second opposed end portion having an dimensional measure; and said dimensional measure of said at least a portion of said annular drive surface being greater than said dimensional measure of said at least a portion of said second opposed end portion.

18. A rock drill according to claim 17, in which said casing has means for admitting hydraulic fluid to said drill, said means including;

port means provided in said casing; and a valve located between said port means and said piston hammer.

19. A rock drill according to claim 18, in which said means for admitting fluid to a drill further includes;

a first annular surface comprising portion of said hammer that faces in the direction of said valve.

20. A rock drill according to claim 17, in which said casing is arranged to be mounted to the front end of a drill tube;

a drill bit slidably received and retained by the front end of said casing and having a channel extending longitudinally therethrough;

a head located at the rear of said casing;

a port means in said head and arranged for being supplied with pressurized hydraulic fluid from said drill tube;

said piston hammer being arranged to repetitively deliver impacts to said drill bit and having a longitudinal channel therethrough;

a flushing channel extending from said valve to the front end of said drill bit and including said channels in said piston hammer and said drill bit;

said piston hammer having a first surface located in a first pressure chamber for driving said piston hammer forwardly when said first pressure chamber is pressurized, and a second surface in a second chamber arranged for driving said piston hammer rearwardly when said first chamber is depressurized, said valve being arranged to alternately connect said first pressure chamber to said port means and to said flushing channels so as to reciprocate said piston hammer, said piston hammer comprises;

a major central portion in a central chamber in the casing and front and rear portions having reduced diameters;

said casing including guiding portions for receiving and guiding said front and rear portions respectively of said piston hammer whereas said central portion of said piston hammer has a clearance to said casing to permit hydraulic fluid to bypass said central portion during reciprocation of said piston hammer;

said valve being arranged in said head rearwardly of said piston hammer;

said head including a tube sealingly extending into said channel in said piston hammer, said first piston surface being said annular end face of said rear portion of said piston hammer;

said valve being a spool valve that is coaxial with said tube and has a rearward position in which it connects said first chamber to said tube and a forward position in which it connects said first chamber to said port means;

wherein, in operation, said second chamber is continuously pressurized and said second piston surface has a smaller effective area than said first piston surface;

said second chamber and said central chamber are separated with said second chamber being located between said first chamber and said central chamber;

said central chamber being connected to said flushing channel through a narrow passage; and said valve is adapted to be pressure biased in one direction and adapted to reciprocate in response to the position of said hammer by the intermediary of an annular control groove provided on a drive piston that serves to alternately relieve said valve to said flushing channel, and which moves said valve in one direction and pressurizing said valve to move it in the opposite direction.

21. A drill according to claim 5, wherein at least two thirds of the length of the piston hammer is unguided and located in said second chamber.

22. A drill according to claim 21, wherein at least half of the length of the piston hammer has a diameter larger than that of its guiding means.

* * * * *